United States Patent [19]

Kosmahl

[11] Patent Number: 4,890,036

[45] Date of Patent: Dec. 26, 1989

[54] MINIATURE TRAVELING WAVE TUBE AND METHOD OF MAKING

[75] Inventor: Henry G. Kosmahl, Olmsted Falls, Ohio

[73] Assignee: The United States of America as represented by the United States National Aeronautics and Space Administration, Washington, D.C.

[21] Appl. No.: 130,058

[22] Filed: Dec. 8, 1987

[51] Int. Cl.[4] ..... H01J 25/34

[52] U.S. Cl. ..... 315/3.5; 315/3; 331/82

[58] Field of Search ..... 315/3.5, 5, 5.12, 3; 331/82

[56] References Cited

U.S. PATENT DOCUMENTS

| | | | |
|---|---|---|---|
| 2,924,738 | 2/1960 | Chodorow | 315/3.5 |
| 3,443,146 | 5/1969 | Buck | 315/3.5 |
| 4,439,746 | 3/1984 | Epsztein | 331/82 |

*Primary Examiner*—Robert L. Griffin
*Assistant Examiner*—T. Salindong
*Attorney, Agent, or Firm*—James A. Mackin; Gene E. Shook; John R. Manning

[57] ABSTRACT

It is an object of the invention to provide a miniature traveling wave tube which will have most of the advantages of solid state circuitry but with higher efficiency and without being highly sensitive to temperature and various types of electromagnetic radiation and subatomic particles as are solid state devices.

The traveling wave tube which is about 2.5 cm in length includes a slow wave circuit (SWS) comprising apertured fins with a top cover which is insulated from the fins by strips or rungs of electrically insulating, dielectric material.

Another object of the invention is to construct a SWS of extremely small size by employing various grooving or etching methods and by providing insulating strips or rungs by various deposition and masking techniques.

12 Claims, 3 Drawing Sheets

MINIATURE TRAVELING WAVE TUBE AND METHOD OF MAKING

ORIGIN OF THE INVENTION

This invention was made under NASA contract NAS3-24565 and has been assigned to the Administrator of the National Aeronautics and Space Administration.

TECHNICAL FIELD

This invention relates to traveling wave tubes (TWT) and is directed more particularly to a miniature TWT.

Because of the burgeoning use of satellites for communications, transmitting tubes operating in the 5 to 60 GHz range are required in order that a greater number of messages may be carried in a particular radio frequency signal. Further, present and future needs will utilize phased array antennas or radar systems made up of a large number of small individual transmitters of relatively low power of from 0.1 to 10 watts for each transmitter. Each array may consist of, for example, 100 transmitters. Such arrays are electronically steerable and each transmitter may radiate RF directly into open space.

Many phased array antennas utilize solid state devices to provide a large number of individual transmitting units which are electrically steerable. Unfortunately, solid state devices are sensitive to temperature and extraneous radiation such as gamma rays, x-rays, neutrons, and protons. Furthermore, solid state devices have a lower power output, a narrower frequency range and a lower efficiency than TWTs utilizing an electron beam.

For passage of an electron beam, some TWTs of the prior art provided notches in the top edges of the propagating plates or fins to avoid the impossibility of mechanically assembling such structures with accurately aligned apertures for the beam. However, for TWTs operating above, for example, 5 GHz, the spacing when a top cover is added is entirely insufficient for the beam.

Accordingly, it is an object of the invention to provide a traveling wave tube having many of the advantages of solid state devices such as miniature size and suitability to non-mechanical construction.

It is another object of the invention to provide a traveling wave tube having 1 to 5 watts power output, 3 kV or less electron accelerating voltage and operating in the 5 to 60 GHz range.

Still another object of the invention is to provide a miniature TWT with apertured propagating fins, wherein the apertures are accurately aligned and are at a point of high impedance to a slow wave.

An additional object of the invention is to provide a traveling wave tube which may not require severs.

BACKGROUND ART

U.S. Pat. No. 4,439,746 to Epsztein discloses a microwave oscillator in which a wave guide cavity is provided with upstanding, apertured vanes and having coupling slots provided in the cavity between successive pairs of vanes.

U.S. Pat. No. 3,443,146 to Buck discloses a traveling wave tube wherein the delay structure discloses apertured propagating members extending from at least one wall of the tube, the propagating members being connected to one another at alternate positions by bars to form the equivalent of a helix slow wave structure.

U.S. Pat. No. 2,924,738 to Chodorow discloses a slow wave structure with interdigital apertured fins. The fins have alternating negative and positive potentials.

Many traveling wave tubes are known which include helically wound or coupled cavity slow wave structures.

DISCLOSURE OF THE INVENTION

In accordance with the invention, there is provided a miniature, low-voltage TWT including a slow wave structure comprising successive apertured fins extending from a bottom base member. The top cover plate is disposed on the fins opposite the base member with an electrically insulating layer disposed between the fins and the top cover. The electrically insulating layer is a dielectric material having a dielectric constant of 10 or less.

Techniques such as vapor deposition, sputtering, or ion beam implantation in a pattern which will be in register with the top edges of the apertured fins. Strips of dielectric material may be mechanically disposed between the fins and the top cover plate.

Preferably a cold cathode is utilized to provide an electron beam which interacts with an injected RF signal and passes through the apertures in the fins. At the end of the tube opposite the cathode, a multi-stage depressed collector may be incorporated to capture the spent electrons at high efficiency.

For purposes of clarity, the drawings are not to scale and dimensions are not in proportion to actual sizes.

DETAILED DESCRIPTION OF THE INVENTION

Figure 1:
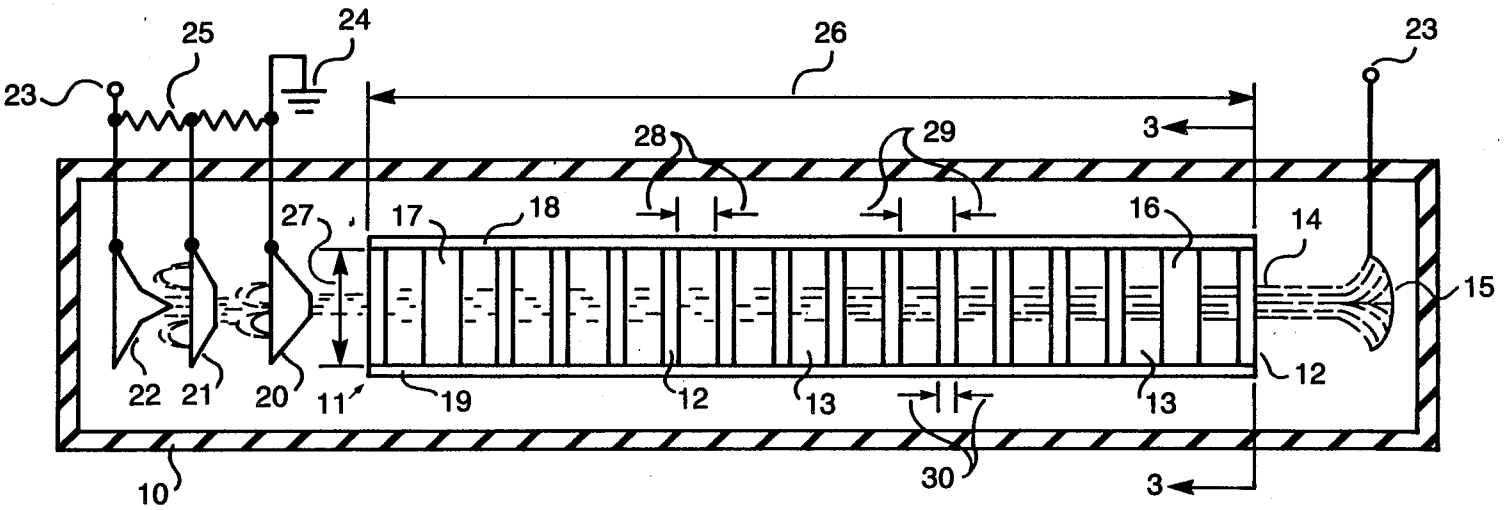
FIG. 1 is a schematic top view of a travelling wave tube embodying the invention.

Referring now to FIG. 1, there is shown a traveling wave tube 10 constructed of an electrically insulating material such as glass. Disposed inside the TWT 10 is a slow wave circuit 11 comprised of a plurality of thin, apertured fins 12 which all extend in a common direction from a base member 13. The SWS may be copper or silicon. If silicon is employed, a plating of an electrically conductive material such as gold or copper must be applied to the silicon.

With relationship to an electron beam 14 emitted by a cathode 15, the fin 12 at the extreme right of the SWS 11 may be considered as a first upstream fin while the fin 12 at the extreme left of the SWS may be identified as the last downstream fin. Thus, an input coupling slot 16 in the base member 13 is located immediately downstream of the first fin 12 while an output coupling slot 17 is positioned upstream of the last fin 12. The cathode 15 is preferably a cold cathode but a miniature thermionic cathode may be used.

The coupling slots 16 and 17 are preferably the same width as the fins 12 in order to provide the correct matching to impedance matching transformers horns which will be attached to the slots 16 and 17 as will be described presently. If the coupling slots 16 and 17 are as just described, that is, the same width as fins 12, there will be no structure to support the first and last fins 12. Accordingly, flanges 18 and 19 are provided along the length of the base plate to provide the necessary support for the first and last fins 12.

At the end of TWT 10 opposite the cathode 15 there is provided a multistage depressed collector comprised of collector plates, 20, 21, and 22. A high voltage, on the order of 1–3 kV, is applied between a terminal 23 and ground 24 across a voltage divider 25. Collector electrode 20 is connected to the ground point and collector electrode 22 is connected to the high negative voltage terminal 23 while the collector electrode 21 is connected to an intermediate point on the voltage divider 25. The voltage divider 25 is exemplary only, as a high efficiency traveling wave tube would utilize well known components other than resistors to provide an intermediate voltage for collector plate 21.

The length of the SWS is indicated by the double ended arrow 26 while the width of the fin 12 is indicated by the double ended arrow 27. Opposing arrows 28 specify the spacing between fins 12 while double ended arrows 29 indicate the distance from the front surface of a particular fin to the front surface of the next downstream fin 12 (the period of the SWS). The thickness of the fins 12 is shown by the opposing arrows 30.

Figure 2:
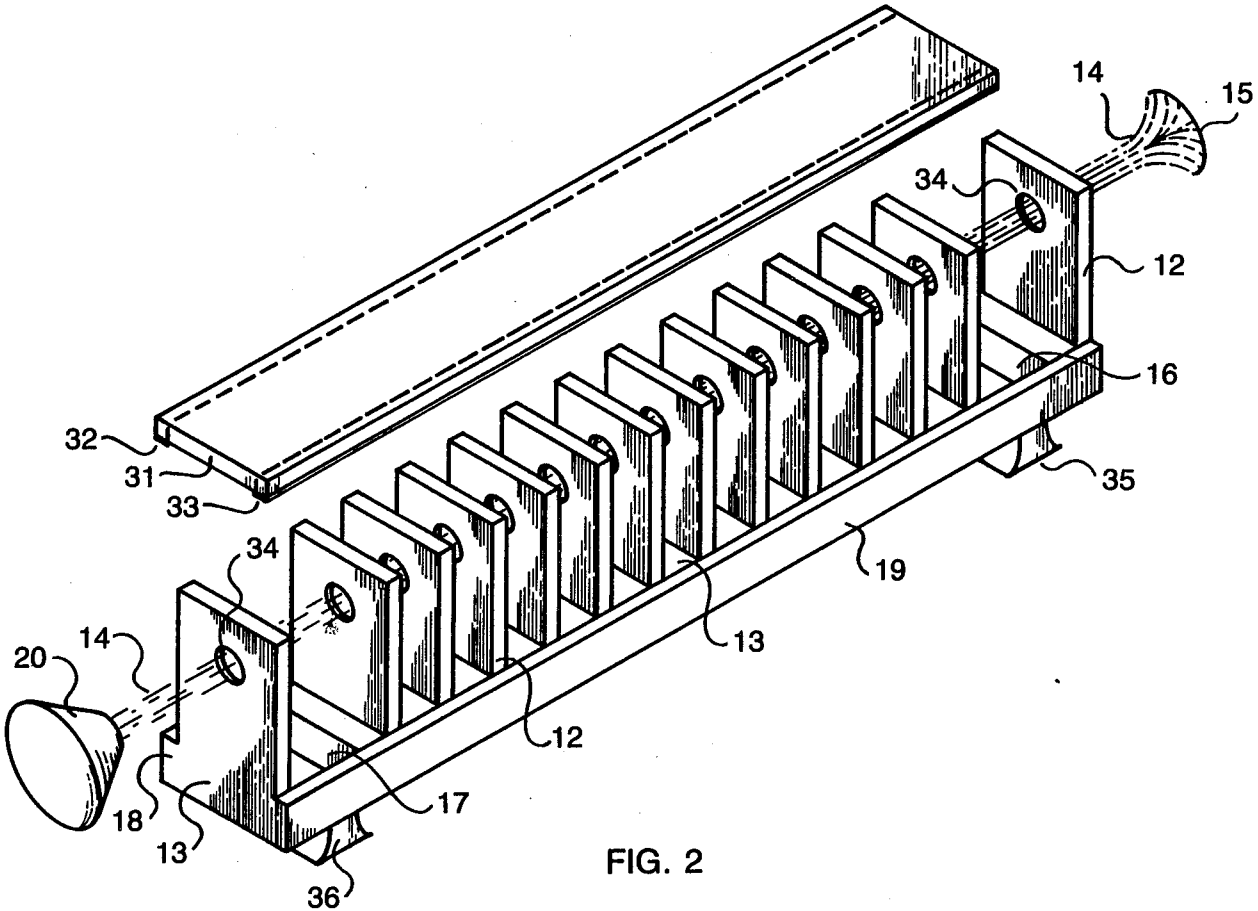
FIG. 2 is an oblique view schematic drawing of the amplifying SWS and its top cover.

Referring now to FIG. 2, there is shown an oblique schematic view of the SWS 11 of FIG. 1 wherein parts identical to parts in FIG. 1 are identified by like numerals. As shown, the slow wave circuit 11 is provided with a top cover plate 31 having longitudinal strips of electrically insulating material 32 and 33 attached to its lower surface. The insulating strips 32 and 33 run lengthwise along the edges of the top cover plate 31 to establish a separation between the strips. The purpose of the separation is to avoid any buildup of charge on strips 32 and 33 and to provide a space between the top of the fins 12 and the cover plate 31 for the slow wave to propagate along the electron beam while the circuit wave travels a much longer path up and down the fins 12, the bottom base walls and then around the top of each of the fins 12 into the next fin. An accumulation of charge on strips 31 and 32 could cause arcing at various points on the SWS 11.

The fins 12 are provided with respective aligned apertures 34 through which electron beam 14 passes. In order to match the impedance of the input coupling slot 16 and the output coupling slot 17 to wave guides, respective horns or matching transformers 35 and 36 are attached to the base member 13.

Figure 3:
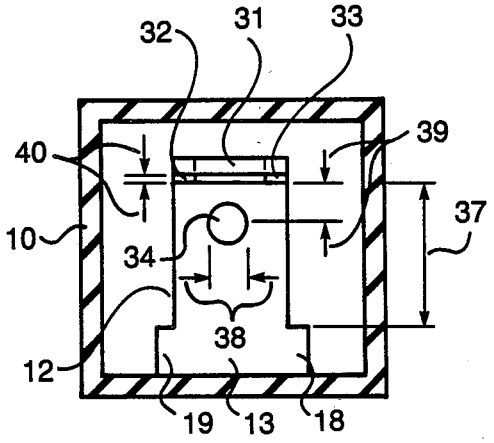
FIG. 3 is a cross sectional view of the TWT of FIG. 1 taken along the line 3—3.

Referring now to FIG. 3, parts corresponding to those of FIGS. 1 and 2 are identified by corresponding numerals. A double ended arrow 37 indicates the height of the fin 12 while opposed arrows 38 show the diameter of the aperture 34. The distance of the center of aperture 34 from the top edge of fin 12 is indicated by opposing arrows 39 while opposing arrows 40 show the thickness of the insulating strips 32 and 33.

Figure 4:
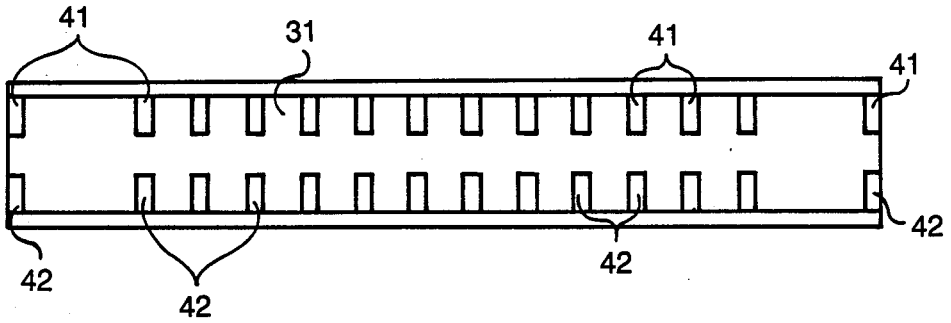
FIG. 4 is a bottom view of a top cover plate for the SWS showing rung insulating layer members each rung having a gap.

FIG. 4 is a bottom view of a top cover plate 31 for an alternate embodiment of the invention in which the electrically insulating layer attached to the cover plate 31 is in the form of a row of rungs 41 and a row of rungs 42, each row extending inwardly from respective opposite edges of the cover plate 31. The rungs 41 are directly opposite respective rungs 42.

The rungs extend inwardly only to the extent that they not interact with the electron beam to become charged as discussed previously with respect to the separation of the electrically insulating strips 32 and 33 of FIG. 2. The rungs 41 and 42 are precisely located so they will be in register with respective ones of said fins 12 when the top cover plate 31 is disposed against the top edges of the fins 12.

The miniature TWT 10 of FIG. 1 utilizes a voltage of only 1 to about 3 kV to accelerate the electrons of the beam 14. The current of the electron beam is also quite low being in range from about 1 to 10 mA.

A TWT embodying the invention for operation in the 5 to 60 GHz range and at 1 to 5 watts of power will have the approximate dimensions as set forth in Table I below.

TABLE I

| Arrow Numeral | Function | Dimensions (metric) |
|---|---|---|
| 26 | TWT length, 30 GHz | about 2.5 cm |
| 27 | Fin width | $\lambda_0/4$ or less |
| 28 | Distance between fins | (0.2–1.0 mm)-(0.1–0.7 m) |
| 29 | Spacing of fins (period) | 0.2–1.0 mm |
| 30 | Fin thickness | 0.1–1.0 mm |
| 37 | Fin height | 1.0–10 mm |
| 38 | Aperture diameter | 0.25–1.0 mm |
| 39 | Distance from top of fin to aperture center | 0.1–0.3 times fin height |
| 40 | Thickness of electrically insulating layer | 0.1–1.0 times fin spacing |

where $\lambda_0$ is the free space wavelength.

The center of the aperture 34 is about 0.7 to 0.9 times the dimension 37 (fin height) from the base 13. This position is also defined as 0.1 to 0.3 times the dimension 37 from the top edge of the fin 12.

To construct a SWS in accordance with the invention an elongated block of material such as copper or silicon is cut to the length of the required SWS. Next a passageway is drilled through the block from end to end. The location of the passageway is dictated by opposing arrows 39 of FIG. 3 as specified in TABLE I above. One of the long surfaces of the block is then subjected to transverse electron discharge grooving, transverse ion beam etching, or reactive sputtering to remove material. The removal of material is continued until the fins 12 formed by the grooving process are of the desired height.

The second fin from each end of the SWS are eliminated during the grooving process to provide space for the respective input and output coupling ports, 16 and 17, respectively. The coupling ports 16 and 17 are formed by one of the same processes used for the grooving and are sized for impedance matching with the coupling transformers or horns 35 and 36 of FIG. 2. These transformers or horns are attached by soldering or the like to the coupling openings 16 and 17 in the base plate 13. If the SWS is made from silicon, plating with an electrically conductive material will be required as mentioned previously.

A top cover the same length as the SWS and of the same material is provided to be disposed against the top edges of the fins 12 opposite the base plate. A thin layer of electrically insulating material is disposed as strips 32 and 33 on the bottom surface of the top cover plate to separate it from the fins 12. The strips 32 and 33 may be Mylar, mica, quartz, boron nitride, aluminum oxide, polytetrafluoroethylene, or the like either attached to the top cover by a suitable adhesive or lain lengthwise on the fins before the cover is put in place. The electrically insulating strips 32 and 33 may also be formed by the electro-deposition, ion beam implantation, vapor deposition, or sputtering of materials such as diamond, aluminum oxide, boron nitride, quartz, or polytetrafluoroethylene.

Another embodiment of top cover plate 31 shown in FIG. 4 utilizes inwardly extending rungs 41 and 42 which, as explained previously, are in register with the fins 12 of the SWS 11. To form the rungs 41 and 42, the bottom surface of the top cover plate 31 is masked by various well known techniques with a slit provided at the desired position of each rung member. The electrically insulating dielectric material is then deposited by one or more of the various means discussed previously. The masking material is then removed and the top cover is cleaned and placed on the fins 12. The top cover may be retained in place by various clips or straps, by adhesives or by soldering.

It will be understood that various changes and modifications may be made to the above-described invention without departing from its spirit and scope as set forth in the claims appended hereto.

I claim:

1. A miniature traveling wave tube (TWT) having a slow wave circuit (SWS) utilizing an electron beam, the SWS comprising:

an elongated base member having an input port and an output port, said ports being at opposite ends of said base member;

a plurality of parallel rectangular fins extending in the same direction from said base member, each of said fins having an aperture, the apertures all being aligned on an axis parallel to said base member for passage of the electron beam through the aperatures, the center of each aperture being positioned a measured distance from a top surface of said base member, said measured distance being between 0.7 and 0.9 times the distance from said top surface of the base member to a top edge of each respective fin, the alignment of the apertures being established by a drilled passageway in a block of material from which the base and fins are formed;

an elongated top cover disposed adjacent to top edges of said fins and opposite said base member;

an electrically insulating layer selected from the group of dielectric materials consisting of diamond, aluminum oxide, boron nitride, quartz and polytetrafluoroethylene disposed between said top cover and said fins, said electrically insulating layer being in contact with said fins and said top cover and comprising at least two strips of the dielectric material extending perpendicular to the rectangular fins and separated sufficiently to avoid interaction with the electron beam;

and wherein said electrically insulating layer has been disposed on the top cover by vapor deposition, electrodeposition, sputtering or ion beam deposition.

2. The SWS of claim 1 wherein the insulating layer has a dielectric constant preferably less than 10.

3. The SWS of claim 1 wherein said electrically insulating layer comprises two rows of inwardly extending, opposed rungs bonded to a bottom surface of said top cover, said rungs being spaced to be in register with said fins and wherein the respective opposed rungs extend inwardly no farther than a distance at which they would begin to interact with the electron beam.

4. The SWS of claim 1 wherein said base member said fins and said top cover are copper.

5. The SWS of claim 1 wherein the center of each aperture is at about 0.9 the distance from the base member to a top edge of the fin adjacent the electrically insulating material.

6. A method of making a miniature traveling tube (TWT) utilizing a slow wave structure (SWS) and an electron beam comprising the steps of:

providing an elongated block of electrically conducting material having a height greater its width;

drilling a passageway through said block from end to end;

removing material transversally to the length of said elongated block at a plurality of predetermined locations between from a top surface toward a bottom surface thereby forming a base member and fins having apertures which are aligned, the center of each aperture being positioned a measured distance from a top edge of its respective fin, said measured distance being between 0.1 and 0.3 times said height of the respective fin;

disposing by electrodeposition, vapor deposition or sputtering strips of an electrically insulating dielectric material lengthwise along the edges of a bottom surface of a top cover plate to insulate the top cover plate from the fins, said strips being separated sufficiently to avoid interaction with the electron beam;

disposing said top cover plate with the electrically insulating material contacting each of said fins, said cover plate being juxtaposed on said fins thereby forming a SWS; and disposing the SWS in a TWT electrically insulating housing with the apertures aligned on the electron beam.

7. The method of claim 6 wherein said electrically insulating material has a dielectric constant preferably less than 10.

8. The method of claim 6 wherein the dielectric strips are selected from the group of materials consisting of diamond, aluminum oxide, boron nitride, quartz, and polytetrafluoroethylene.

9. The method of claim 6 including the steps of applying a mask to said one surface of said cover plate before disposing said electrically insulating material thereon, said mask having a plurality of slits extending inwardly from opposite edges of the cover plate, said slits being positioned to be in register with said fins when the cover plate is disposed on said fins, said electrically insulating material being deposited on the cover plate through the slits to form rung members; and removing said mask prior to disposing said cover plate on said fins with the rungs in register with the fins.

10. The method of claim 9 wherein said rung members extend inwardly only sufficiently so that the insulating layer deposited in said slits will have no significant interaction with the electron beam of the TWT.

11. The TWT of claim 1 and including an elongated flange on each side of the SWS base member to maintain the structural integrity of the SWS when the coupling ports are the same width as the fins.

12. The method of claim 6 wherein said block of elongated electrically conductive material is substantially wider for that portion of the block which will serve as the SWS base whereby forming coupling ports in the base will not affect the integrity of the SWS.

* * * * *